US008117797B2

(12) United States Patent
Andras

(10) Patent No.: US 8,117,797 B2
(45) Date of Patent: Feb. 21, 2012

(54) BASEMENT SUMP SYSTEM AND METHOD

(75) Inventor: Stephen Andras, Westport, MA (US)

(73) Assignee: DNI Reality, LLC, Westport, MA (US)

( * ) Notice: Subject to any disclaimer, the term of this patent is extended or adjusted under 35 U.S.C. 154(b) by 0 days.

(21) Appl. No.: 12/875,569

(22) Filed: Sep. 3, 2010

(65) Prior Publication Data

US 2011/0056152 A1 Mar. 10, 2011

Related U.S. Application Data

(62) Division of application No. 11/529,060, filed on Sep. 28, 2006, now Pat. No. 7,788,877.

(51) Int. Cl.
*E04B 1/00* (2006.01)

(52) U.S. Cl. ..... 52/741.11; 52/741.3; 52/169.1; 52/169.5; 52/169.14; 52/192; 52/302.1; 52/302.3

(58) Field of Classification Search ..... 52/19, 107, 52/169.1, 169.5, 169.6, 169.7, 169.14, 192, 52/302.1, 302.3, 741.1, 741.3, 741.11
See application file for complete search history.

(56) References Cited

U.S. PATENT DOCUMENTS

| | | | |
|---|---|---|---|
| 1,681,394 | A | 8/1928 | Carlson |
| 1,771,770 | A | 7/1930 | Bruno |
| 2,941,635 | A | 6/1960 | Harris |
| 3,283,460 | A | 11/1966 | Patrick |
| 3,304,672 | A | 2/1967 | Bakke |
| 3,344,569 | A | 10/1967 | Cotten |
| 3,713,539 | A | 1/1973 | Thompson et al. |
| 4,185,429 | A | 1/1980 | Mendola |
| 4,245,443 | A | 1/1981 | Beechen |

(Continued)

FOREIGN PATENT DOCUMENTS

| | | |
|---|---|---|
| GB | 2115885 | 9/1983 |

(Continued)

OTHER PUBLICATIONS http://www.basementsystems.com/content/47/669/673/default.aspx (accessed Mar. 15, 2006).

(Continued)

*Primary Examiner* — Brian Glessner
*Assistant Examiner* — Patrick Maestri
(74) *Attorney, Agent, or Firm* — Lando & Anastasi, LLP

(57) ABSTRACT

A sump system for use in basement waterproofing systems. A sump liner may be generally rectangular in geometry, and may include two side elements with apertures to exchange groundwater while blocking debris. An adjustable inlet may be provided in another side element to fluidly connect other elements of a basement waterproofing system to the sump liner. The sump liner may further include a base configured to provide a built-in stand for a sump pump. The pump stand may contain a lip with notches to allow debris to fall and collect in a trough around a periphery of the base. The base may further provide an underside cavity for accommodating an obstruction in the floor of a sump hole. A removable lid may facilitate access to the sump liner interior, and may contain a break-away feature to accommodate discharge piping, as well as a groove to lodge a pump power cord. The sump liner may be strategically oriented within the sump hole to protect the basement foundation from erosion.

7 Claims, 7 Drawing Sheets

U.S. PATENT DOCUMENTS

| | | | | |
|---|---|---|---|---|
| 4,265,064 | A | 5/1981 | Parezo | |
| 4,333,281 | A | 6/1982 | Scarfone | |
| 4,660,333 | A | 4/1987 | Romer | |
| 4,726,490 | A | 2/1988 | Bonnema et al. | |
| 4,745,716 | A | 5/1988 | Kuypers | |
| 4,837,991 | A | 6/1989 | Shaw | |
| 4,845,910 | A | 7/1989 | Hanson | |
| 4,869,032 | A | 9/1989 | Geske | |
| 4,943,185 | A | 7/1990 | McGuckin et al. | |
| 4,983,069 | A | 1/1991 | Florence | |
| 5,086,594 | A * | 2/1992 | Florence | 52/169.5 |
| 5,199,232 | A | 4/1993 | Chandler et al. | |
| 5,367,842 | A | 11/1994 | Janesky | |
| D354,821 | S | 1/1995 | Janesky | |
| 5,501,044 | A | 3/1996 | Janesky | |
| 5,529,436 | A | 6/1996 | Meyers | |
| 5,694,723 | A | 12/1997 | Parker | |
| 5,727,901 | A * | 3/1998 | Rennie et al. | 405/45 |
| 5,765,323 | A | 6/1998 | Bevilacqua | |
| 5,771,643 | A | 6/1998 | Parker | |
| 5,784,838 | A | 7/1998 | Phillips | |
| 5,794,388 | A | 8/1998 | Jackman | |
| 6,027,283 | A | 2/2000 | Schweinberg et al. | |
| 6,230,468 | B1 | 5/2001 | Klaus | |
| D443,367 | S | 6/2001 | Janesky | |
| 6,308,924 | B1 | 10/2001 | Janesky | |
| 6,361,099 | B1 | 3/2002 | McIntosh et al. | |
| 6,419,421 | B1 | 7/2002 | Whitfield, Jr. | |
| 6,550,190 | B2 * | 4/2003 | Ruiz et al. | 52/169.5 |
| 6,575,666 | B1 * | 6/2003 | Janesky | 405/270 |
| 6,598,360 | B1 | 7/2003 | Pratt | |
| 6,601,607 | B1 | 8/2003 | Pratt | |
| 6,647,682 | B2 | 11/2003 | Bishop | |
| 6,672,016 | B2 | 1/2004 | Janesky | |
| 6,719,004 | B2 | 4/2004 | Huber et al. | |
| 6,848,468 | B1 | 2/2005 | Hsien | |
| 6,904,723 | B1 | 6/2005 | Moore et al. | |
| 7,303,357 | B2 | 12/2007 | Villarreal et al. | |
| 7,437,855 | B2 | 10/2008 | Locke et al. | |
| 7,954,280 | B2 | 6/2011 | Andras | |
| 2002/0152696 | A1 | 10/2002 | Ruiz et al. | |
| 2003/0115814 | A1 | 6/2003 | Nielsen | |
| 2005/0198916 | A1 | 9/2005 | Janesky | |
| 2006/0032158 | A1 | 2/2006 | Moule | |
| 2007/0044396 | A1 | 3/2007 | Janesky | |
| 2007/0068093 | A1 | 3/2007 | Grange et al. | |
| 2007/0094952 | A1 | 5/2007 | Niemczyk | |
| 2007/0175113 | A1 | 8/2007 | Moule | |
| 2007/0294965 | A1 | 12/2007 | Andras | |
| 2008/0104910 | A1 | 5/2008 | Andras | |

FOREIGN PATENT DOCUMENTS

| | | |
|---|---|---|
| GB | 2155076 | 9/1983 |
| JP | 02132258 | 5/1990 |

OTHER PUBLICATIONS http://www.basementsystems.com/images/WaterGuard_In_Progress.jpg (accessed Mar. 15, 2006).
http://www.basementsystems.com/content/47/71/default.aspx (accessed Mar. 15, 2006).
http://www.basementtechnologies.com/products/wraqua.html (accessed Mar. 15, 2006).
http://www.fasteel.com/WaterProofing.htm (accessed Mar. 8, 2006).
http://www.basementtechnologies.com/WGBullDog.html (accessed Sep. 11, 2006).
http://www.basementtechnologies.com/WGBullDog2.html (accessed Sep. 11, 2006).

* cited by examiner

BASEMENT SUMP SYSTEM AND METHOD

RELATED APPLICATIONS

This application is a divisional application, and claims the benefit under 35 U.S.C. §120, of pending U.S. patent application Ser. No. 11/529,060, entitled "Basement Sump System and Method," filed on Sep. 28, 2006, which is herein incorporated by reference in its entirety.

BACKGROUND OF THE INVENTION

1. Field of the Invention

At least one embodiment of the present invention relates generally to devices and methods for basement waterproofing and, more particularly, to sump systems and methods for use in basement waterproofing systems.

2. Discussion of Related Art

The potential for moisture in the basement of buildings is of ongoing concern to homeowners, building contractors, and structural engineers. Basement foundation footings are typically located several feet below ground level, and water may accumulate around the foundation as the groundwater level periodically rises, for example, due to rain or melting snow. As a result, hydrostatic pressure may build causing leakage at cracks in the footings, structural interfaces, and through the floor. Concrete, typically used in the construction of foundations, attracts groundwater by sorption, and capillary forces in the concrete pores facilitate further penetration of the groundwater. Seepage of groundwater into a basement can cause significant structural damage, as well as promote the growth of harmful bacteria, such as iron bacteria. Furthermore, dangerous radon gas, and water vapors contributing to a high basement humidity level, can flow easily through the concrete pores.

Interior, sub-floor drainage systems have been developed to address problems with moisture in basements. Such systems typically include a drainage conduit installed along the interior perimeter of the basement, positioned below the basement floor and in close proximity to the foundation wall. The drainage conduit serves to collect and convey groundwater to a basement sump for extraction.

In general, the sump is a sub-floor water collection zone positioned at the lowest point of the basement, often in a corner, so that groundwater naturally drains towards it. Within a sump hole, a sump pump is typically housed in a sump liner to discharge groundwater. Traditional sump liners are circular in design, about two feet in diameter, two to three feet deep, and contain a plurality of drilled apertures around their periphery to allow for the exchange of groundwater while limiting entry of gravel and dirt. A pump stand, conventionally positioned in the bottom of the sump liner, elevates the sump pump in order to adjust level controls and to allow sediment and debris to settle without interfering with operation of the sump pump. Several inches of coarse gravel may also be placed in the bottom of the sump liner to provide a solid foundation for the sump pump. A two-piece lid is traditionally secured with screws over the sump liner, flush with the basement floor, in order to accommodate discharge piping.

BRIEF SUMMARY OF THE INVENTION

In accordance with one or more embodiments, the invention relates generally to an improved sump for use in basement waterproofing systems.

In accordance with one or more embodiments, the invention relates to a basement sump liner comprising a housing defining a chamber constructed and arranged to collect groundwater for extraction, the housing having a base with a top surface defining a bottom of the chamber and a bottom surface defining a cavity.

The base may comprise an integral pump stand extending into the chamber. The pump stand may include a pump shelf. A lip along a periphery of the pump shelf may define a plurality of notches. At least a first side element of the housing may comprise a substantially solid surface which may include an inlet to facilitate fluidly connecting the sump liner to a basement waterproofing system component. A knockout feature for forming the inlet may be included, and the inlet may be adjustable. At least a second side element of the housing may define a plurality of apertures. The base may define a trough within the chamber along a periphery of the pump stand. The sump liner may include a detachable lid which may have a break-away feature, a groove at a point along its perimeter, and/or a removable plug. The base may be substantially rectangular in geometry and may comprise a support structure within the cavity. The sump liner may be about 18 to 20 inches deep, and the cavity may be about two inches deep. The first side element and the second side element may be removably attached to the base.

In accordance with one or more embodiments, the invention relates to a sump kit comprising a sump liner having a chamber constructed and arranged to collect groundwater for extraction, the sump liner having at least one detachable side element with a substantially solid surface.

The sump liner may include a detachable base with a top surface defining a bottom of the chamber, and a bottom surface defining a cavity. The detachable base may comprise an integral pump stand, and the sump liner may further include a removable lid having a break-away feature. The kit may further include a sump pump, discharge piping to facilitate groundwater extraction by a sump pump, and/or a slidable cover constructed and arranged over an opening in the housing to facilitate securing a basement waterproofing system component to an inlet of the sump liner.

In accordance with one or more embodiments, the invention relates to a method of waterproofing a basement comprising providing a sump liner having a chamber constructed and arranged to collect groundwater for extraction, the sump liner having a first side element with a substantially solid surface, and positioning the sump liner within a sump hole such that the first side element with a substantially solid surface is proximate to a foundation wall of the basement.

The sump liner may be positioned in a corner of the basement. The method may further include fluidly connecting the sump liner to a drainage conduit. A height of a sump liner inlet may be adjusted to fluidly connect the sump liner to the drainage conduit. The sump liner may include a second side element having a plurality of apertures and the method may further include positioning the second side element opposite the first side element.

Other advantages, novel features and objects of the invention will become apparent from the following detailed description of the invention when considered in conjunction with the accompanying drawings.

BRIEF DESCRIPTION OF THE DRAWINGS

The accompanying drawings are not intended to be drawn to scale. In the drawings, each identical or nearly identical component that is illustrated in various figures is represented by like numeral. For purposes of clarity, not every component may be labeled in every drawing. Preferred, non-limiting embodiments of the present invention will be described with reference to the accompanying drawings, in which.

DETAILED DESCRIPTION OF THE INVENTION

Figure 1:
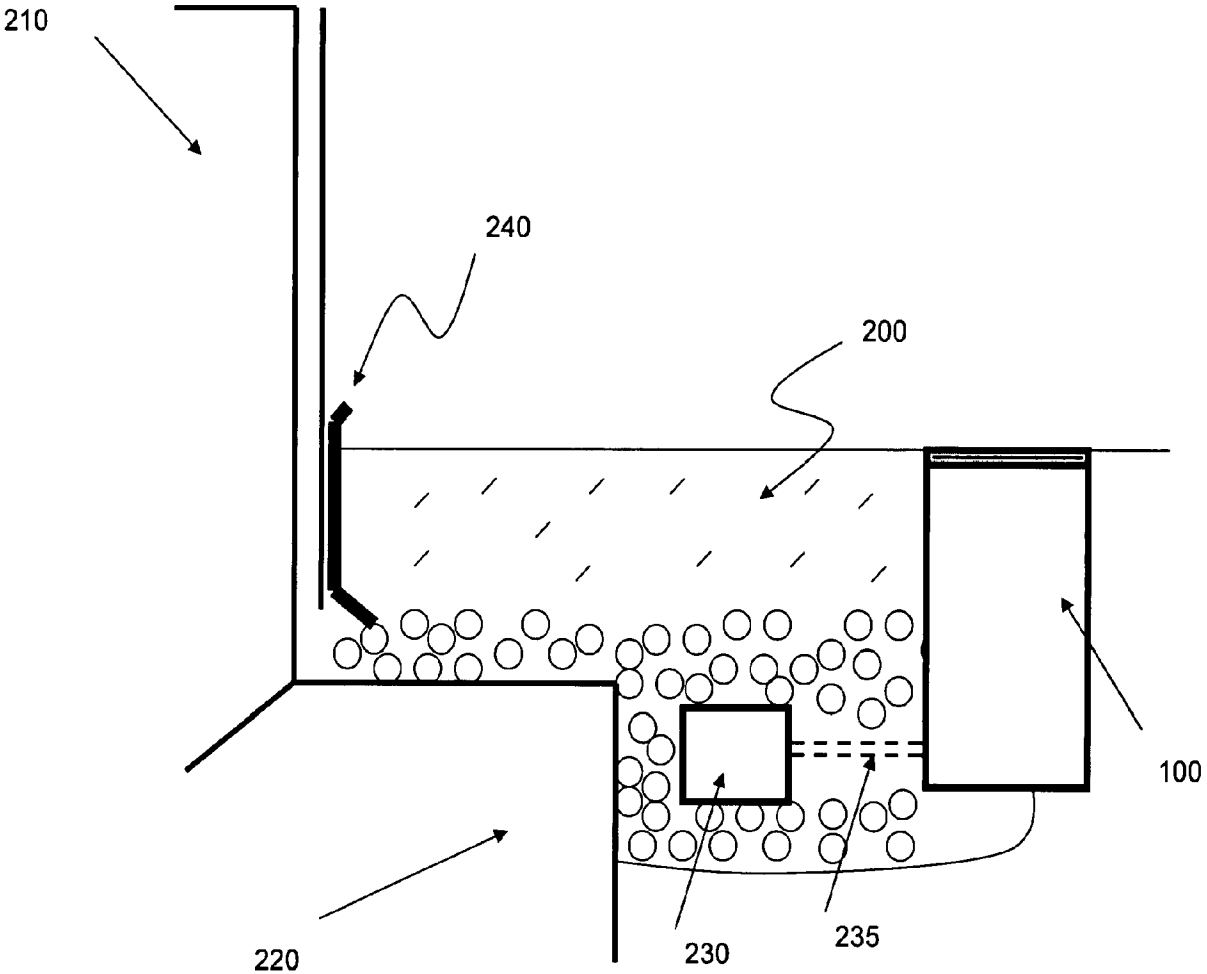
FIG. 1 illustrates a sump system installed as part of a basement waterproofing system in accordance with one or more embodiments of the present invention.

This invention is not limited in its application to the details of construction and the arrangement of components as set forth in the following description or illustrated in the drawings. The invention is capable of embodiments and of being practiced or carried out in various ways beyond those exemplarily presented herein.

In accordance with one or more embodiments, the present invention relates generally to an improved basement sump system for use in basement waterproofing. The sump system may be effective in collecting and discharging groundwater to a remote location in order to prevent penetration of the basement structure. The sump system may be installed within a sump hole in various foundation configurations, typically in close proximity to a foundation wall such as in a corner of a basement or along a straight wall. The sump system may be installed generally so as to promote the flow of groundwater towards the sump system, for example, at the lowest point in a basement floor.

FIG. 1 illustrates a sump system 100 in accordance with one or more embodiments of the present invention positioned in a basement having a basement floor 200, a foundation wall 210 and a foundation footing 220. The sump system 100 may be installed as part of a basement waterproofing system which may, for example, include a drainage conduit 230 disposed along a perimeter of the basement to collect, channel and convey groundwater. The drainage conduit 230 may be fluidly connected to the sump system 100, such as by a conduit port 235, to facilitate collection and discharge of groundwater from the basement. The conduit 230 may be implemented using a conduit as described in copending U.S. patent application Ser. No. 11/471,867 to Andras filed on Jun. 21, 2006 which is hereby incorporated herein by reference in its entirety. The waterproofing system may further include a flange 240 to aid in directing groundwater to the drainage conduit 230. In one embodiment, the flange 240 may be implemented using a flange as described in copending U.S. patent application Ser. No. 11/471,800 to Andras filed on Jun. 21, 2006 which is also hereby incorporated herein by reference in its entirety.

In accordance with one or more embodiments, the sump system may generally include a sump pump housed within a sump liner. Typical sump pumps commonly known to those in the art may be implemented in the present invention, for example, a pedestal or submersible sump pump. The sump pump is often an electric or water-powered device capable of delivering accumulated water from the interior of the sump liner to outside the building structure via associated discharge piping. For example, the sump pump may remove collected ground water to a remote dry well or storm drain. In some embodiments, the discharge piping may comprise one and one-half inch polyvinyl chloride (PVC) plastic piping. The sump pump typically has a float-activated switch to automatically maintain a fluid within the sump liner below a predetermined level, for example, about 10 inches. The vertical position of the sump pump relative to the sump liner may, in part, dictate a threshold fluid level within the sump liner for pump activation. In some embodiments, the sump system may also contain a backup sump pump, sometimes battery powered, in addition to a primary sump pump for further protection.

The sump liner of the present invention may serve to house the sump pump and is typically positioned within the ground beneath the basement floor in a prepared sump hole. The sump liner may safeguard the sump pump from dirt and mud which may clog or otherwise interfere with its normal operation. The sump liner may also define a chamber in which groundwater collects for extraction by the sump pump. One or more inlets in the sump liner may fluidly connect the sump system to a network of sub-floor drainage conduits, and a plurality of apertures in the sump liner may accept additional groundwater from surrounding soil. The sump liner may also include one or more built-in sump pump stands as discussed in further detail below.

The sump liner may be of different sizes and configurations, and is generally shaped so as to match the contour of a sump hole dug for an intended sump system. The sump liner may be separately optimized apart from the sump pump and may be constructed of any material suitable for its intended purpose, such as a high-density polyethylene (HDPE) foam. The sump liner material should be durable, sturdy, and generally compatible with groundwater, soil, concrete, and any minerals or chemicals with which it may come into contact. In some embodiments, the sump liner may be sized to provide a space adequate for accommodating the sump pump and its associated components including discharge piping. Volumetric capacity sufficient to prevent the sump pump from short cycling may be an additional consideration in sizing the sump liner. For example, the sump liner may be sized to hold between about 10 and 25 gallons of groundwater between pumping events.

Figure 2:
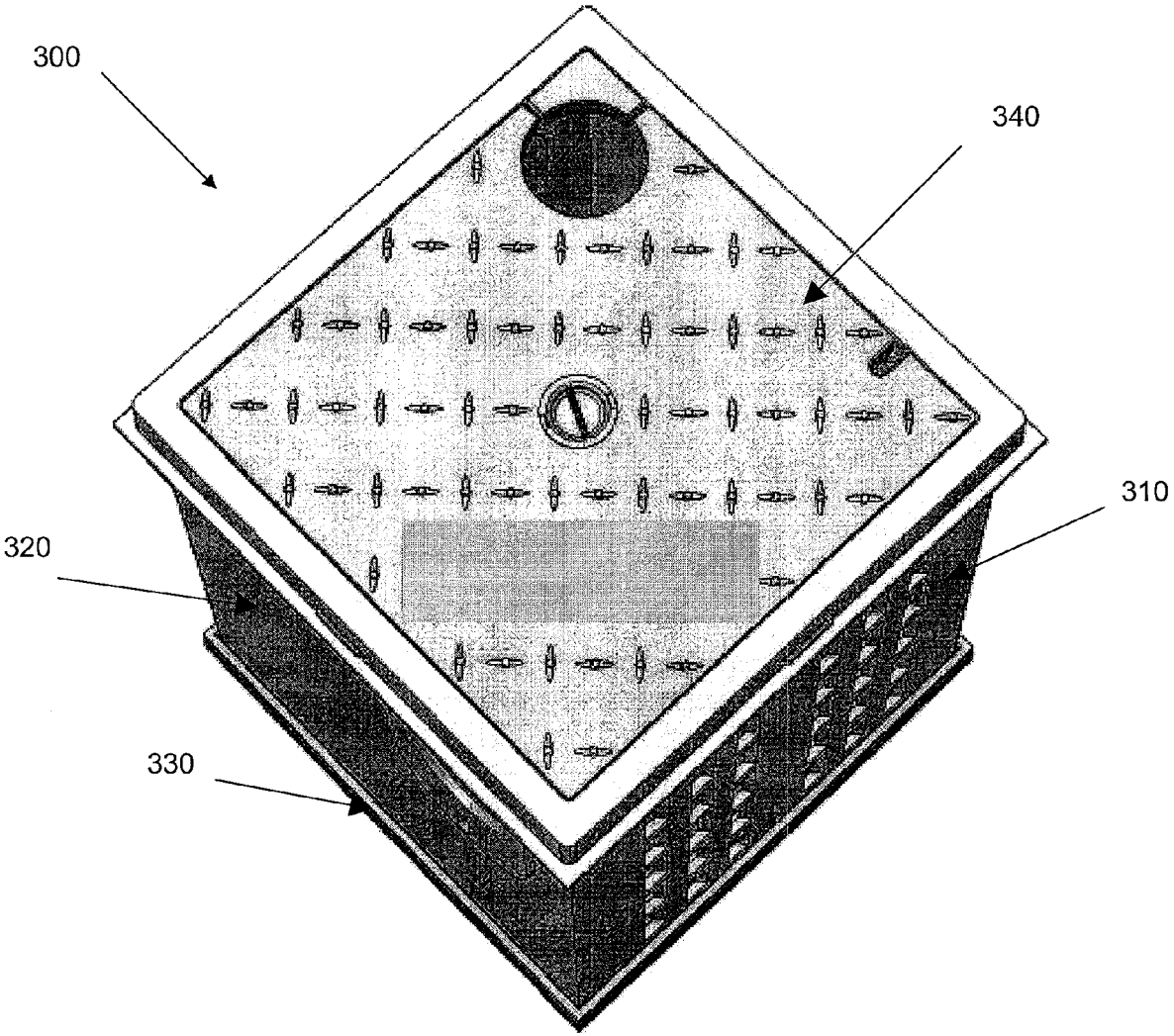
FIG. 2 illustrates a perspective view of a rectangular sump liner in accordance with one or more embodiments of the present invention.

According to one or more embodiments of the present invention, the sump liner may be generally rectangular in design as illustrated in FIG. 2. Without wishing to be bound by any particular theory, a sump system is often positioned in a corner or along a straight wall of a basement and, therefore, a rectangular geometry may provide a better fit with a given foundation arrangement and may prove more effective in collecting groundwater for extraction than other configurations. For example, the sump liner may be shaped as a substantially rectangular box or prism. A substantially rectangular-shaped sump liner 300 in accordance with one or more embodiments of the present invention may generally include two first side elements 310, two second side elements 320, a base 330 and a lid 340.

In some embodiments, the first and second side elements 310, 320 may be substantially identical while, alternatively, they may differ as discussed in greater detail below. Other embodiments of the present invention may include a single first side element 310 and three second side elements 320, or vise versa, depending on the intended application. The two first side elements 310 may be positioned adjacent to one another, or may be alternated with the two second side elements 320, around the perimeter of the base 330. Other arrangements, configurations, or orientations of the four side elements 310, 320 are envisioned beyond those exemplarily presented herein. According to one or more embodiments, the base 330 may be rectangular in geometry. In some embodiments, the base 330 may be square in footprint. The side elements 310, 320 may also be rectangular in geometry. The dimensions of the disclosed rectangular sump liner 300 may vary for different applications but, in general and without limiting the scope of the present disclosure, a typical sump liner 300 may be about 18 to 20 inches deep, for example 19 inches deep, and about 14 to 15 inches square, for example 14.5 inches square.

Figure 3:
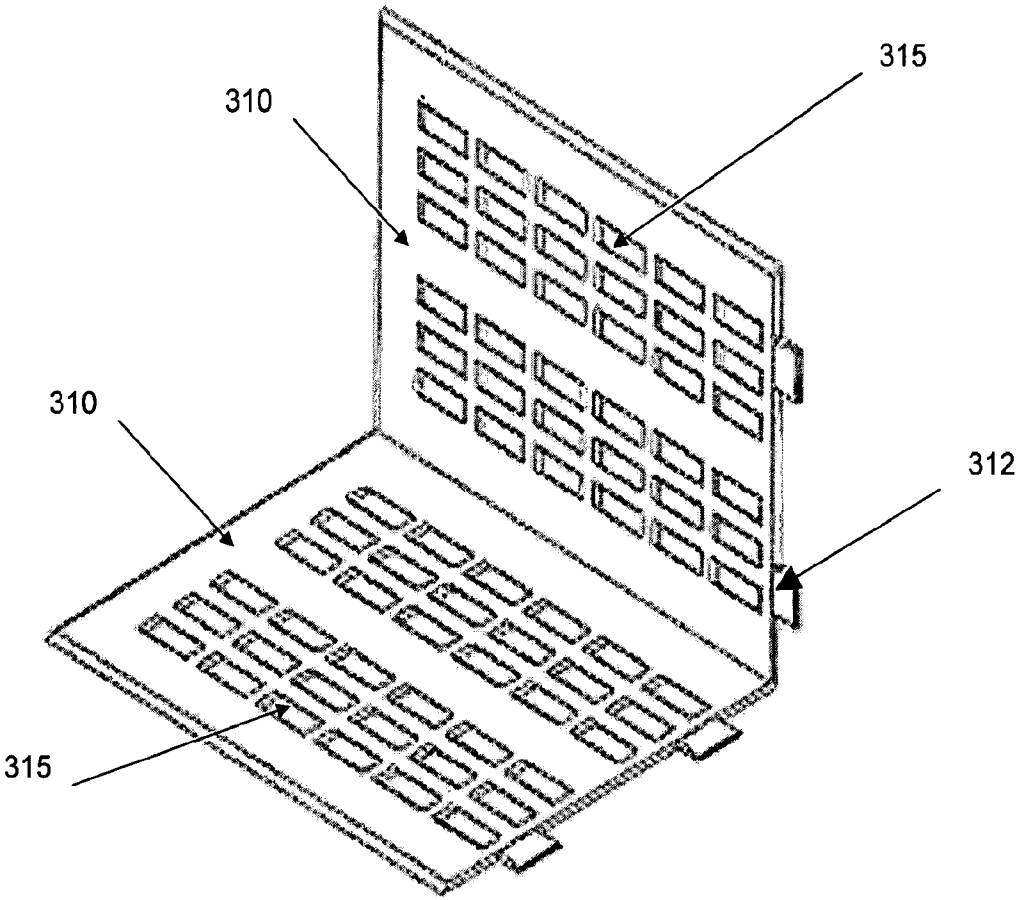
FIG. 3 illustrates a detailed view of sump liner side elements containing apertures in accordance with one or more embodiments of the present invention.

In some embodiments, the first side elements 310 of the sump liner 300 may contain a plurality of apertures 315 as detailed in FIG. 3. The apertures 315 may be of any size and shape, and may be arranged in any pattern, but should generally be designed and positioned to both promote the exchange of groundwater and prevent clogging of the sump liner 300 interior. Groundwater may enter the sump liner 300 via the apertures 315. According to one or more embodiments, the apertures 315 may be shaped as slots and oriented in a uniform pattern across the surface of the first side elements 310, such as in the grate pattern of FIG. 3. Each slot may be, for example, about 1 inch high and about ½ to ¾ inch wide, such as ⅝ inch wide. The apertures 315 may be formed during manufacture of the first side elements 310. In one embodiment, after molding the first side elements 310, a punch-out process may be used to form the slots. The use of such a process may prevent or limit the attachment of harmful bacteria to the sump liner 300 by preventing formation of rough edges around the peripheries of the apertures 315.

Figure 4A:
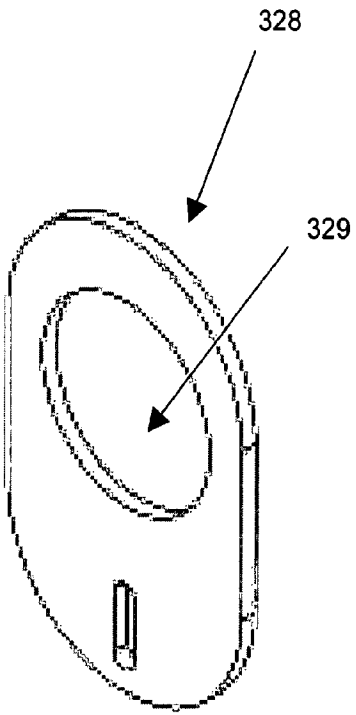
FIG. 4A illustrates a detailed view of a slidable cover which may be used to adjust the height of the inlet of the sump liner side elements of FIG. 4 in accordance with one or more embodiments of the present invention.
Figure 4:
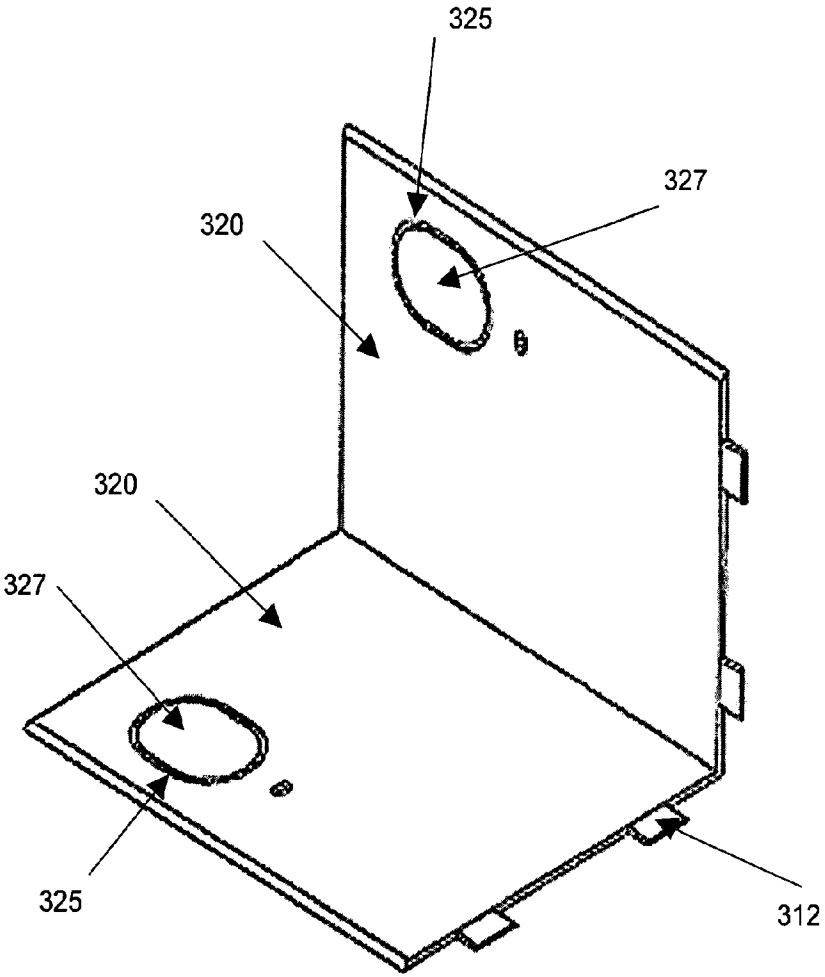
FIG. 4 illustrates a detailed view of sump liner side elements containing inlets in accordance with one or more embodiments of the present invention.

According to one or more embodiments of the present invention, the second side elements 320 of the sump liner 300 may not contain apertures. The second side element 320 may have a substantially solid surface as illustrated in FIG. 4. An opening in the housing, such as an inlet 325, may be included in the second side element 320 for fluidly connecting the sump liner 300 to other components of a basement waterproofing system, such as to a drainage conduit. Groundwater collected from remote locations below the basement floor may therefore be channeled and conveyed to the interior of the sump liner 300 for extraction. In some embodiments, a knockout feature 327 may generally comprise a section of the sump liner 300 that may be easily removed to form the inlet 325 when desired. For example, the knockout feature 327 may be surrounded by a perforation or weakened seam that may be compromised with an exerted force, such as a force provided by a hammer. In a sump liner 300 containing two second side elements 320, neither, one or both knockout features 327 may be utilized to establish fluid connections depending on the desired application and waterproofing system layout.

In at least one embodiment, the position and/or orientation of the inlet 325 may be adjustable, enabling the inlet 325 to accommodate and be connected to ports on a variety of components. The inlet 325 may, for example, be generally elongate in shape and include an adjustment mechanism involving a slidable cover 328, as illustrated in FIG. 4A. The slidable cover 328 may be constructed and arranged to facilitate securing a basement waterproofing system component to the inlet 325. In some embodiments, the slidable cover 328 may be arranged over the inlet 325. The placement of the slidable cover 328 relative to the inlet 325 may be manipulated in order to adjust the vertical height of the inlet 325 for customizable alignment and flexibility in assembling a basement waterproofing system. The slidable cover 328 may be maintained at a desired vertical position relative to the inlet 325 in any sufficient manner, such as with an adhesive or mechanical attachment. For example, one or more screws or other fasteners may be used to maintain a desired height for the inlet 325. In some embodiments, the screws may be inserted from an exterior side of the slidable cover 328, an interior side of the sump liner 300, or both. In at least one embodiment, the slidable cover 328 includes an opening 329, which is smaller than the inlet 325 and is sized to accommodate, for example, a one and one-half inch PVC pipe.

In accordance with one or more embodiments, the sump liner 300 may be strategically oriented within a sump hole to protect the building foundation from groundwater. As discussed above, groundwater may enter the sump liner 300 via the apertures 315. Intake of dirt from the surrounding ground may accompany this intake of groundwater and could undermine the integrity of the building foundation if the apertures were positioned adjacent the foundation wall. Operation of the sump pump may further promote drawing of dirt through the apertures. Thus, during installation, it may be desirable to position the sump liner 300 within the sump hole so as to orient the first side elements 310 (with apertures) away from the basement foundation, and to position the second side elements 320 (without apertures) along the foundation, facing or proximate to the foundation wall. Beneficially, simple rotation of the sump liner 300 may therefore accommodate any corner of a basement structure in this manner. In some embodiments, the second side elements 320 may be positioned or oriented opposite the first side elements 310. In applications where a sump system is to be installed along a straight wall, a sump liner having only a single side element containing apertures may be desirable to limit erosion of the foundation soil.

Figure 5:
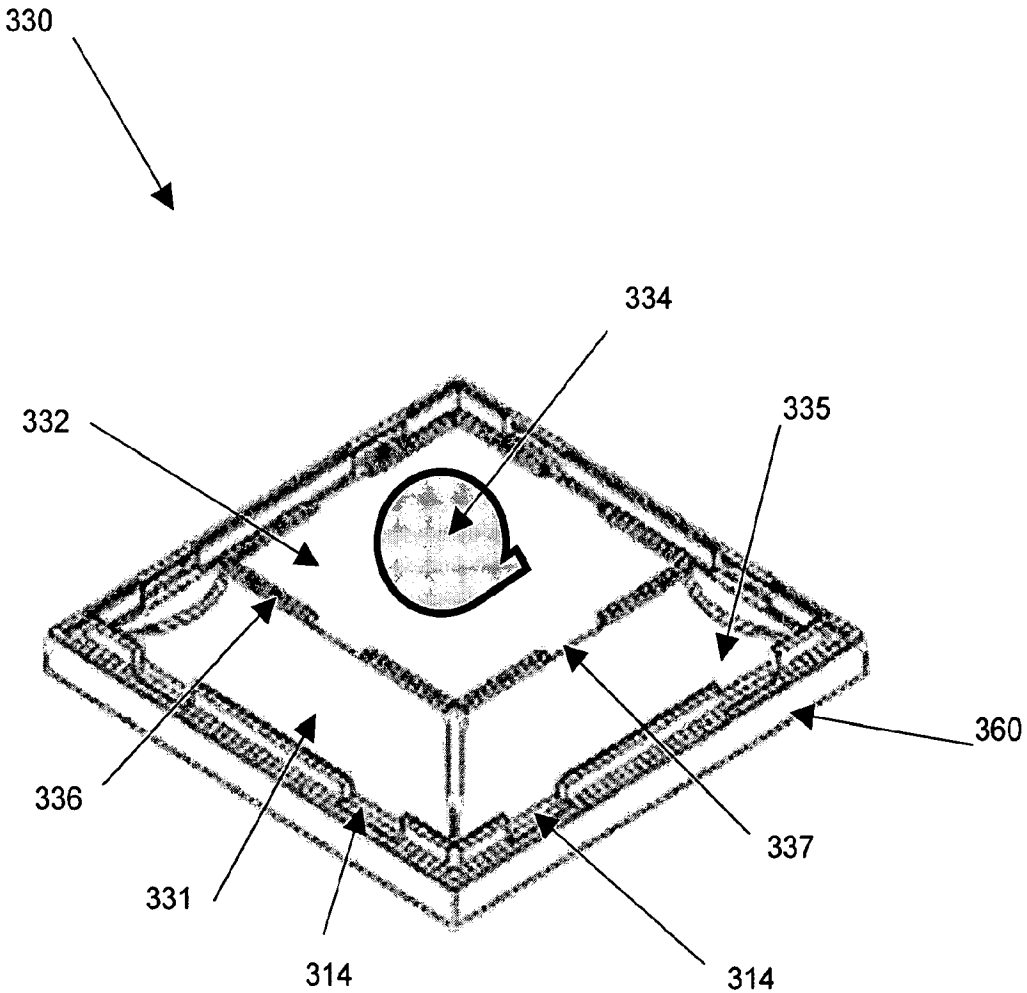
FIG. 5 illustrates a detailed view of a sump liner base in accordance with one or more embodiments of the present invention.

FIG. 5 details a base 330 for the sump liner 300 in accordance with one or more embodiments of the present invention. A top surface 370 (FIG. 5A) of the base 330 may define a bottom of the sump liner 300 chamber. The base 330 may be generally constructed and arranged to provide a built-in pump stand 331 for a sump pump 334. The integral pump stand 331 may extend into the interior of the sump liner 300 in a raised manner, away from the bottom of the sump hole. The pump stand 331 extending into the chamber may be of any size, shape and configuration capable of supporting and elevating the sump pump 334 away from a bottom edge 360 of the sump liner 300. In one embodiment, the integral pump stand 331 may include a pump shelf 332 to support the sump pump 334. In some embodiments, the pump stand 331 may raise the sump pump 334 between 1 to 4 inches, such as about 2 inches, from the bottom edge 360. The pump stand 331 may generally protect the sump pump 334 from dirt and debris, as well as aid in adjusting level controls associated with automatic operation of the sump pump 334. For example, raising the vertical position of the sump pump 334 may raise a threshold groundwater level within the sump liner 300 at which the sump pump 334 automatically activates.

The base 330 may also define a trough 335 along the periphery of the pump stand 331 within the sump liner 300 for collection of debris in order to prevent clogging and interference with normal operation of the sump pump 334. In some embodiments, the base 330 may be shaped such that the pump stand 331 generally slopes upward between the edge 360 and the pump shelf 334 to define the trough 335. The pump stand 331 may be surrounded by a lip 336 including one or more notches 337 to allow dirt to fall down into the trough 335 rather than gathering on the pump shelf 332. In operation, the trough 335 may be periodically cleaned out as part of a sump system maintenance routine.

Figure 5B:
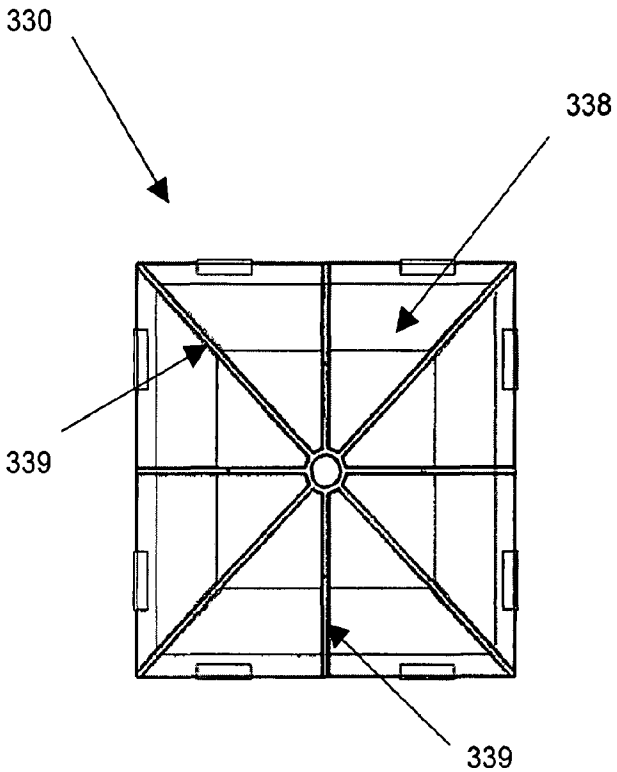
FIG. 5B illustrates a perspective view of an underside of the sump liner base of FIG. 5.
Figure 5A:
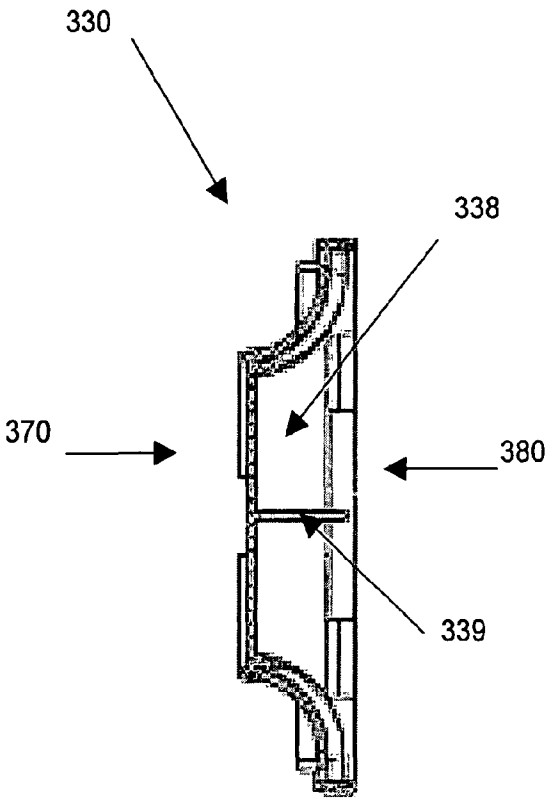
FIG. 5A illustrates a cross-sectional view of the sump liner base of FIG. 5.

In some embodiments, as illustrated in the cross-sectional view of FIG. 5A, the base 330 may be constructed and arranged such that a bottom surface 380 of the base 330 may define a cavity 338 under the pump stand 331. This design may be beneficial in providing a clearance space, aiding the base 330 to fit over obstacles protruding from the floor of the sump hole dug for an intended sump system. For example, the sump liner 300 having the base 330 may measure about 19 inches deep at points along its perimeter but only about 17 inches deep at the sump stand 331. Thus, the bottom surface 380 of the base 330 may define a cavity 338, for example about a 2 inch cavity, to accommodate a ledge, rock or other obstruction in the floor of the sump hole, obviating the need for potentially extensive excavation. In one embodiment, the base 330 may be formed in a substantially convex manner. The base 330 may further include support structures 339 positioned in the cavity 338 under the sump stand 331 for additional strength. In one or more embodiments, the underside of the base 330 may include a network of support structures 339 within the cavity 338 as detailed in FIG. 5B. The support structures 339 may be removable.

The base and side elements of the sump liner may be manufactured as a single unitary piece, such as by a molding process. According to other embodiments of the present invention, the sump liner may be a modular assembly, individual components or sections of which may be separately manufactured. For example, elements 310, 320 and 330 shown in FIGS. 3, 4 and 5 may be individually manufactured for assembly. The individual components may be assembled in any sufficient manner. In general, an assembled sump liner should maintain its intended shape, and be of adequate strength, for example, to support a basement floor applied over it. An assembled sump liner comprised of removable components may be generally capable of disassembly. For example, the first side element 310 and the second side element 320 may be removably attached to the base 330.

In at least one embodiment of the present invention, structural design features of the sump liner components, such as those defining a mating system, may be used to assemble the elements. For example, an assembly system involving male and female mating sections or connectors, such as tongue and grooves, may facilitate assembly of the sump liner without requiring an adhesive or mechanical attachment. In some embodiments, the side elements 310, 320 may include tabs 312 which can be removably received by mating holes 314 in the base 330 during assembly. Depending on the nature of the mating features, a force may be applied to ensure connection between the sump liner elements.

Figure 6:
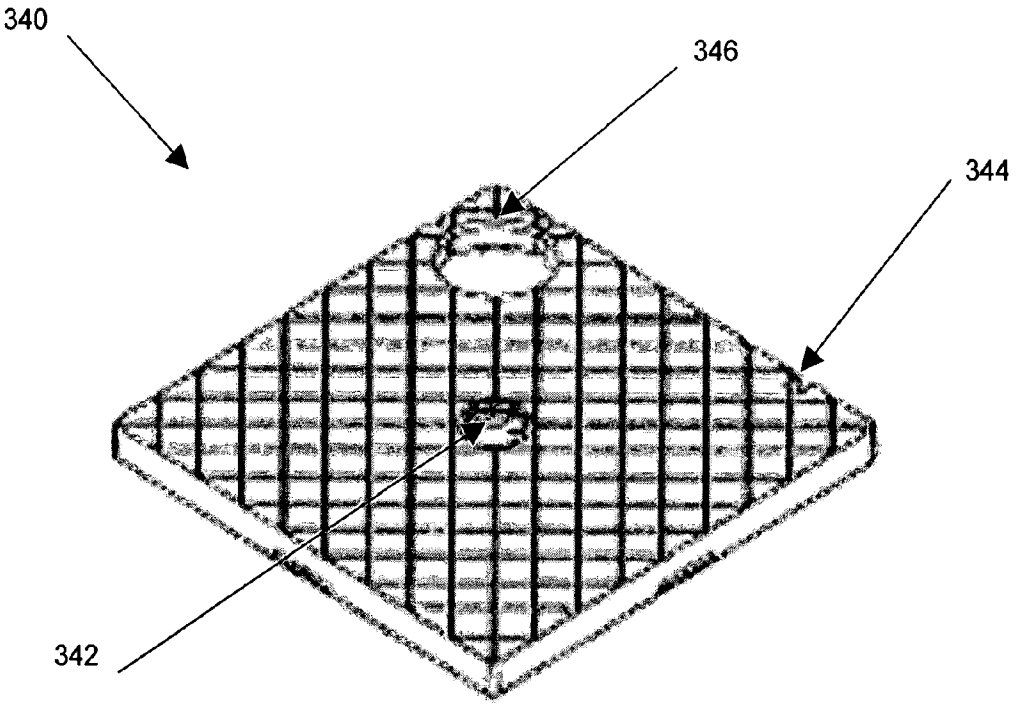
FIG. 6 illustrates a sump liner lid in accordance with one or more embodiments of the present invention.

FIG. 6 details a lid 340 for the sump liner 300 in accordance with one or more embodiments of the present invention. The sump liner 300 may be installed such that the lid 340 may rest generally flush with a basement floor. The lid 340 may be removable or detachable to facilitate access to the interior of the sump liner 300. In operation, the lid 340 may be periodically removed to clean the trough 335 or to service the sump pump 334. The sump liner 300 may generally contain design features allowing the lid 340 to be detachably received by the remainder of the sump liner 300, such as with a snap-on and snap-off technique. The lid 340 may contain a removable plug 342, such as a rubber grommet, to facilitate detaching the lid 340 by insertion of a finger into the lid 340. As illustrated, the removable plug 342 may be centrally located on the lid 340.

In some embodiments, the lid 340 may contain a groove 344 to lodge a power cord of the sump pump 334 when the lid 340 is in position on the sump liner 300. The groove 344 may obviate the need to thread the power cord through the lid 340, and may also allow the lid 340 to be fully removed from the sump liner 300 without disconnecting the power cord from a power supply. The groove 344 may be positioned at any point along the perimeter of the lid 340.

Likewise, a break-away feature 346 in the lid 340 may serve to accommodate discharge piping associated with the sump pump 334, allowing the lid 340 to fit around the discharge piping. When it is desired to remove the lid 340, the breakaway feature 346 may separate from the remainder of the lid 340 in order to fully free the lid 340 from around the discharge piping. The breakaway feature 346 may be rejoined with the remainder of the lid 340 to reinstall the lid 340. The breakaway feature 346 may be created at any desired point in the lid 340, for example, towards a corner as illustrated in FIG. 6. The lid 340 may be freely rotated and attached such that the break-away feature 346 may be oriented in any desired corner of the sump liner 300 for additional flexibility in designing a basement waterproofing system. Beneficially, the lid 340 does not need to be slid up along wires or piping, nor does anything need to be disconnected from the sump pump 334, in order to fully remove the lid 340, thus allowing for uninterrupted operation of the sump pump 334.

In at least one embodiment, an antimicrobial agent, such as one commonly known to those skilled in the art, may be incorporated into the sump liner material prior to manufacture in order to impart antimicrobial properties to the end product. For example, the antimicrobial compound may be added in an amount of about three to five percent by weight. Without wishing to be bound to any particular theory, a sump liner having an antimicrobial active surface may be effective in preventing the development of a harmful biofilm thereon, such as one containing iron bacteria.

A sump kit may be provided for assembly of a sump system in accordance with one or more embodiments of the present invention. For example, the sump kit may include a sump liner constructed and arranged substantially as described above. The sump kit may provide instructions regarding digging and preparing a sump hole sufficient to accommodate the sump liner. The kit may further include a sump pump and associated discharge piping. Optionally, a backup sump pump may also be provided to impart additional protection. Fasteners to facilitate securing fluid connections between the sump liner and other components of a basement waterproofing system, such as drainage conduits, may also be provided in the sump kit.

Existing sump systems may be retrofitted in accordance with one or more embodiments of the present invention. For example, a sump liner in a preexisting sump hole may be replaced with a sump liner constructed and arranged substantially as described herein. Replacement may involve reshaping the sump hole to accommodate the new substantially rectangular sump liner, such as by filling or excavation. Any previously implemented pump stands may be discarded. An existing sump pump may then be housed in the replacement sump liner, or a new sump pump may be provided. Fluid connections may be made between the new sump liner and other components of a preexisting basement waterproofing system. Additional components, for example a drainage conduit, may also be installed as part of a retrofit application.

While the built-in pump stand of the present invention has been exemplarily discussed herein as being formed as part of a sump liner base, other embodiments of the present invention may incorporate a pump stand into the side elements or another component of the sump liner.

Additional grooves and/or breakaway features may be incorporated into the lid of the sump liner to accommodate additional wires and/or piping.

While backup sump pumps have been described as accompanying a primary sump pump in a single sump liner, it is also envisioned that two or more sump systems may function in a network. For example, two or more sump liners may be installed in close proximity and may be fluidly connected to each other. In some embodiments, a sump pump housed in one sump liner may serve as a backup for a sump pump positioned in another sump liner.

Other embodiments of the sump system of the present invention, and methods for its installation and use, are envisioned beyond those exemplarily described herein.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims.

Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Those skilled in the art should appreciate that the parameters and configurations described herein are exemplary and that actual parameters and/or configurations will depend on the specific application in which the systems and techniques of the invention are used. Those skilled in the art should also recognize, or be able to ascertain, using no more than routine experimentation, equivalents to the specific embodiments of the invention. It is therefore to be understood that the embodiments described herein are presented by way of example only and that, within the scope of the appended claims and equivalents thereto, the invention may be practiced otherwise than as specifically described.

What is claimed is:

1. A method of waterproofing a basement, comprising:

providing a sump liner having a top, a bottom, and 4 side elements defining a chamber constructed and arranged to collect groundwater for extraction, the sump liner having:

a first side element with a substantially solid surface, and a second side element defining a plurality of apertures;

positioning the sump liner within a sump hole such that the first side element with a substantially solid surface is proximate to a foundation wall of the basement, and the second side element defining a plurality of apertures is oriented away from the foundation wall of the basement; and positioning a sump pump within the liner.

2. The method of claim 1, wherein positioning the sump liner within the sump hole comprises positioning the sump liner in a corner of the basement.

3. The method of claim 1, further comprising fluidly connecting the sump liner to a drainage conduit.

4. The method of claim 3, wherein fluidly connecting the sump liner to the drainage conduit comprises adjusting a height of an inlet of the sump liner.

5. The method of claim 1, wherein the sump liner has a base defining an integral pump stand extending into the chamber and the method further comprises positioning the sump pump on the integral pump stand.

6. The method of claim 1, wherein the sump liner is substantially modular and the method further comprises assembling the modular sump liner.

7. The method of claim 2, wherein the sump liner is substantially rectangular having two side elements with a substantially solid surface and two side elements defining a plurality of apertures, wherein the step of positioning the sump liner within the sump hole comprises positioning the two side elements with a substantially solid surface proximate foundation walls in the corner of the basement.

* * * * *